US005743067A

United States Patent [19]

Trimani

[11] Patent Number: 5,743,067

[45] Date of Patent: Apr. 28, 1998

[54] DEVICE FOR LOADING STORAGE CONTAINERS FOR ELONGATED ARTICLES

[75] Inventor: Carlo Trimani, Bologna, Italy

[73] Assignee: G.D Societa' Per Azioni, Bologna, Italy

[21] Appl. No.: 594,250

[22] Filed: Jan. 30, 1996

[30] Foreign Application Priority Data

Feb. 2, 1995 [IT] Italy ..... BO95A0033

[51] Int. Cl.[6] ..... B65B 19/10; B65B 5/10

[52] U.S. Cl. ..... 53/151; 53/245; 53/536; 131/282

[58] Field of Search ..... 131/282, 283; 53/536, 245, 151

[56] References Cited

U.S. PATENT DOCUMENTS

| | | | |
|---|---|---|---|
| 3,241,289 | 3/1966 | Molins | 131/283 |
| 3,324,623 | 6/1967 | Johnson, Jr. et al. | 198/418 |
| 5,464,027 | 11/1995 | Bina et al. | 131/283 |
| 5,617,943 | 4/1997 | Belvederi et al. | 198/418 |

FOREIGN PATENT DOCUMENTS

| | | | |
|---|---|---|---|
| 958406 | 5/1964 | United Kingdom | 53/151 |
| 958407 | 5/1964 | United Kingdom | 53/151 |

*Primary Examiner*—Vincent Millin
*Assistant Examiner*—Charles W. Anderson
*Attorney, Agent, or Firm*—Labas & Parry

[57] ABSTRACT

A device for loading storage containers for elongated articles, particularly tobacco products, wherein a feedbox for the articles presents an output window facing a horizontal plate for supporting an orderly mass of articles; the output window is defined by the side by side output openings of a number of side by side channels for respective columns of articles; the horizontal plate is movable vertically along a storage container positioned with its input opening facing the output window, and presents side by side seats on top for respective articles; each output opening faces a rib separating two respective adjacent seats on the horizontal plate;

and the channels are all inclined to the same side in relation to the plate.

12 Claims, 4 Drawing Sheets

DEVICE FOR LOADING STORAGE CONTAINERS FOR ELONGATED ARTICLES

BACKGROUND OF THE INVENTION

The present invention relates to a device for loading storage containers for elongated articles.

The present invention is particularly suitable for use in the manufacture and packing of tobacco products, particularly cigarettes, to which the following description refers purely by way of example.

In cigarette manufacturing plants, any difference in the output of the cigarette manufacturing machine and the packing machine connected to it is taken up by large compensating stores connected permanently to a line between the two machines, or by a store of substantially infinite capacity, defined by any number of movable cigarette storage containers, which are filled or emptied, depending on whether the output of the manufacturing machine is greater or less than that of the packing machine.

When using storage containers, the plant necessarily comprises two devices for respectively loading and unloading the containers, and connected parallel to the line between the manufacturing and packing machines.

Known container loading devices comprise an input feedbox with a bottom outlet defined by the aligned outlets of a number of side by side channels for respective columns of cigarettes; and a support for the container, which is positioned with its upper opening beneath the bottom outlet of the feedbox.

The main problem when filling the container is to ensure the cigarettes are loaded in as orderly a manner as possible, both to ensure the container is filled to its maximum capacity, and to prevent the cigarettes, during subsequent handling of the full container, from settling crosswise inside any gaps in the mass of cigarettes inside.

As a quincuncial arrangement is the most orderly for a mass of cigarettes, the above problem therefore amounts to feeding the cigarettes accordingly into the container.

In the past, this has always been achieved by transversely shifting either the container, or alternate cigarettes issuing from the feedbox channels, by an amount equal to the radius of the cigarette.

In addition to subjecting the cigarettes to transverse stress resulting in tobacco fallout, the above known solutions also involve numerous actuating elements cooperating with the container or located at the outlet of the feedbox channels, and which seriously complicate the structure of the loading device.

SUMMARY OF THE INVENTION

It is an object of the present invention to provide a storage container loading device designed to overcome the aforementioned drawbacks.

According to the present invention, there is provided a device for loading storage containers for elongated articles, in particular tobacco products; the device comprising a feedbox for the articles, in turn comprising an outlet defined by a number of side by side channels for respective columns of said articles, each channel presenting an output opening, and said outlet presenting a bottom output window defined by said side by side output openings; a horizontal plate for receiving and supporting a mass of articles issuing from said output window; and actuating means for moving said plate along a storage container positioned, in use, with its input opening beneath said output window; characterized in that the horizontal plate presents, on top, side by side seats for respective said articles; each seat being separated by a rib from each adjacent seat; each said output opening facing a rib separating two respective adjacent seats on the plate; and the channels all being inclined to the same side in relation to the plate.

According to a preferred embodiment of the above device, the channels are parallel, and preferably form an angle of 50 to 70 degrees, and preferably of substantially 60 degrees, with the plate.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
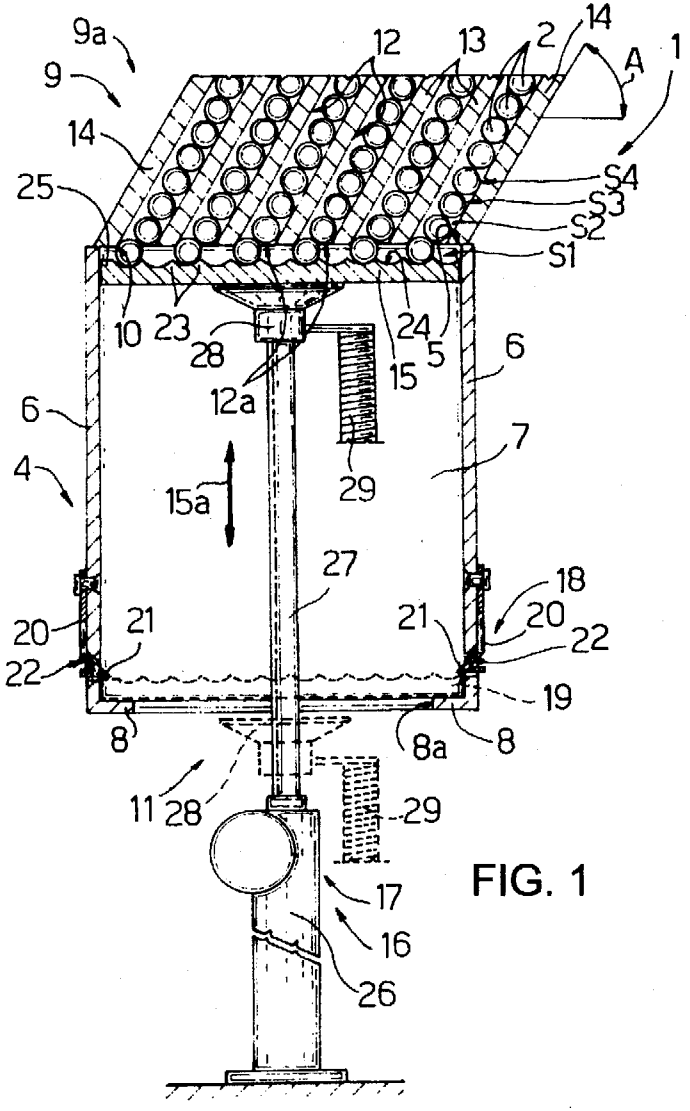
FIG. 1 shows a cross section, with parts removed for clarity, of a first preferred embodiment of the storage container loading device according to the present invention.

Number 1 in FIG. 1 indicates a loading device for feeding cigarettes 2 in an orderly manner into a storage container 4 substantially in the form of a rectangular parallelepipedon. Container 4 presents a top opening 5 through which to feed in cigarettes 2, and comprises two vertical lateral walls 6 on either side of opening 5, a rear wall 7, and, for each wall 6, a stop appendix 8 located at the bottom end of container 4 and extending transversely from respective wall 6 towards the other appendix 8 with which it defines the bottom opening 8*a* of container 4, parallel to and facing top opening 5.

Device 1 also comprises a feedbox 9*a* in turn comprising an outlet 9 with a bottom output window 10; and a lifting device 11 located beneath window 10, and movable to and from window 10 in a substantially vertical direction and along a container 4 supported, by known supporting means (not shown), in a fixed position with opening 5 facing window 10.

Figure 2A:
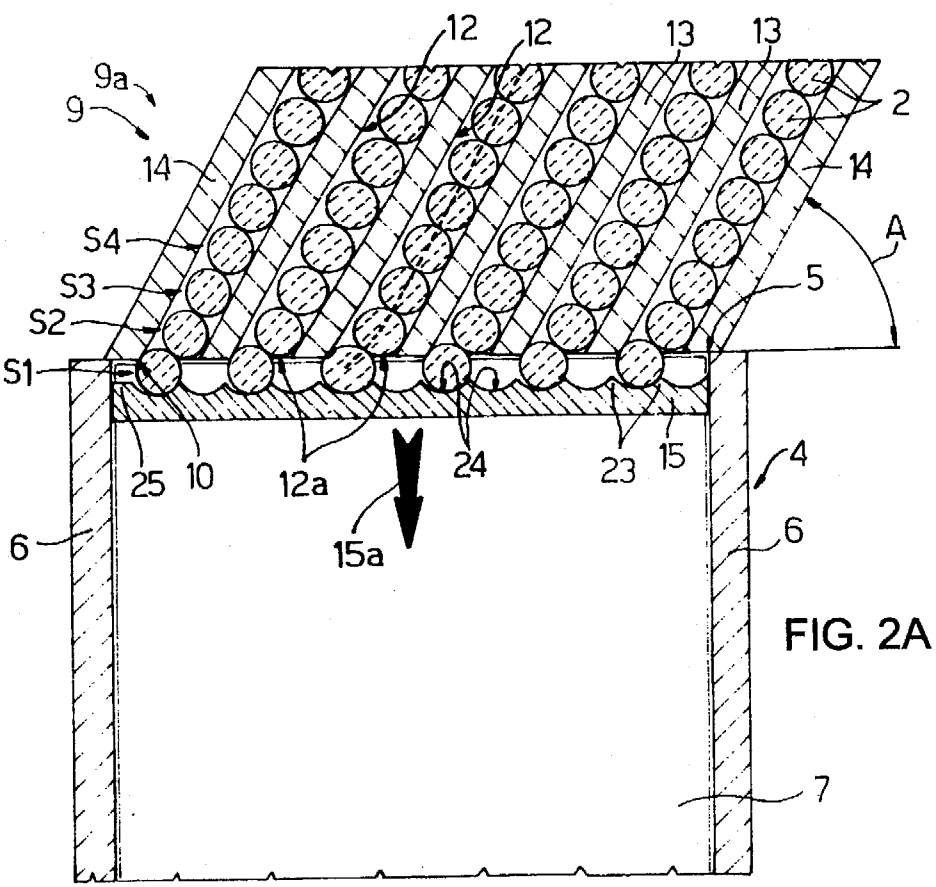
FIGS. 2A and 2B show details of FIG. 1 on larger scales.
Figure 2B:
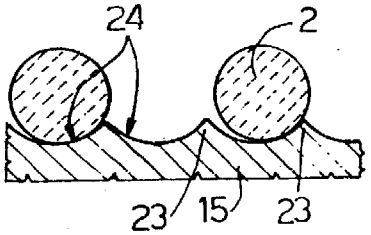

As shown in FIGS. 1 and 2, outlet 9 is defined by a number of side by side channels 12 of a width approximately equal to but no smaller than the diameter of cigarettes 2, and which, at the bottom, present respective side by side openings 12*a* defining window 10. Channels 12 are separated by a number of partitions 13 located between the two outer lateral walls 14 of outlet 9, all slope upwards from window 10 on the same side in relation to the vertical (to the right in the drawings), and at least the end portion of channels 12 close to window 10 forms an angle A of a given size as defined later on.

Device 11 comprises a horizontal supporting plate 15 beneath and facing window 10; and an actuating unit indicated as a whole by 16 and in turn comprising an actuating device 17 for moving plate 15, parallel to itself and in a vertical direction 15*a*, between a raised position in which plate 15 is located directly beneath bottom window 10, and a lowered position in which a clamping device 18, fitted to walls 6 of container 4, snaps plate 15 onto appendixes 8 so that it is integral with and defines the bottom wall 19 of container 4.

Device 18 comprises a pair of flat springs 20, each fitted to the outside of a respective wall 6 of container 4, and each presenting an end tooth 21 projecting inside container 4, and which is pushed back by plate 15 into a respective cavity 22 formed in respective wall 6, and snaps back out over plate 15 to lock it releasably onto appendixes 8.

On the side facing window 10, plate 15 presents a number of equally spaced transverse ribs 23 defining a number of substantially semicylindrical seats 24 for housing respective cigarettes 2; which seats 24 are equal to twice the number of channels 12, present a curve radius approximately equal to but no smaller than that of cigarettes 2, and a width substantially equal to that of channels 12. More specifically, each channel 12 is associated with a pair of respective adjacent seats 24, the dividing rib 23 of which is located substantially beneath the center line of opening 12*a* of channel 12.

At the lateral end opposite the side towards which channels 12 slope upwards (the left lateral end in the drawings), plate 15 presents a flat projection 25 of a width substantially equal to the curve radius of seats 24.

As shown in FIG. 1, actuating device 17 comprises a linear actuator 26, the vertical output rod 27 of which engages, in use, bottom opening 8*a* of container 4, and is fitted on its free end with a suction cup 28 activated via a conduit 29. Suction cup 28 releasably engages the underside of plate 15 to support it and move it between said raised and lowered positions, and is detached from plate 15 in the lowered position in which, as stated, plate 15 is made integral with container 4 by clamping device 18.

Figure 8:
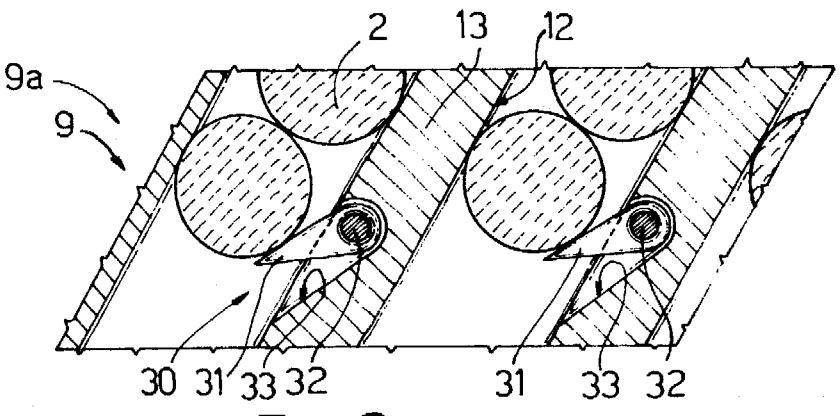

As shown in FIG. 8, device 1 also comprises a control valve device 30 upstream from window 10 of outlet 9, and which provides for arresting the downward movement of cigarettes 2 inside respective channels 12 to enable the full container 4 to be replaced by an empty one. For each channel 12, device 30 comprises a substantially wedge-shaped element 31 supported, by means of a respective pin 32 crosswise to respective channel 12, inside a respective seat 33 formed in one of the two partitions 13 defining respective channel 12. Pins 32 are all connected, in known manner (not shown), to a motor (not shown) so as to swing respective elements 31 between an operating position (FIG. 8) in which they at least partly engage respective channels 12 to arrest cigarettes 2, and an idle position (not shown) in which elements 31 are housed inside respective seats 33.

Operation of loading device 1 will now be described with reference to FIGS. 2A to 6, and as of an initial condition (FIG. 2A) in which plate 15 is set to the raised position, i.e. separated from window 10 by a distance approximately equal to but no greater than the diameter of cigarette 2.

In the following description, the four layers of cigarettes 2 over plate 15 in the above initial condition are indicated S1, S2, S3 and S4.

The angle of inclination A of channels 12 is such that, when plate 15 is set to said raised position, the axis of each channel 12 intersects, of the two respective seats 24, the one closest to projection 25 and which hereinafter will be referred to as the "odd seat 24". Consequently, since the center line of each opening 12*a* is located directly over the rib 23 separating the respective two seats 24; since, in the raised position, plate 15 is separated from window 10 by a distance approximately equal to but no greater than the diameter of seat 24, i.e. the diameter of cigarette 2; and since said axis of channel 12 intersects the respective odd seat 24 at a distance from respective rib 23 substantially equal to the curve radius of seat 24, the angle A formed between each channel 12 and plate 15 is between 50 and 70 degrees, and is preferably very close to 60 degrees.

Consequently, when, in the initial condition, device 30 is opened to free channels 12, the columns of cigarettes 2 inside channels 12 move down transversely to their axes so that cigarettes 2 in layer S1 are fed into odd seats 24, and even seats 24 are left empty.

At this point, actuating device 17 is operated to lower plate 15, so that cigarettes 2 in layer S2 drop out through respective openings 12*a* (FIG. 3) and are directed rightwards into even seats 24 by the cigarettes 2 in layer S1. The cigarettes 2 in layers S1 and S2 are thus arranged alternately in the same horizontal plane defined, in this case, by the upper surface of plate 15, and themselves define seats 34 substantially similar to but offset in relation to seats 24, and a first of which, in this case an odd seat 34, is located directly over projection 25.

The slightly larger curve radius of seats 24 as compared with that of cigarettes 2 enables the cigarettes 2 inside odd seats 24 to shift slightly from the stable balanced position and so facilitate insertion of cigarettes 2 inside even seats 24.

Figure 4:
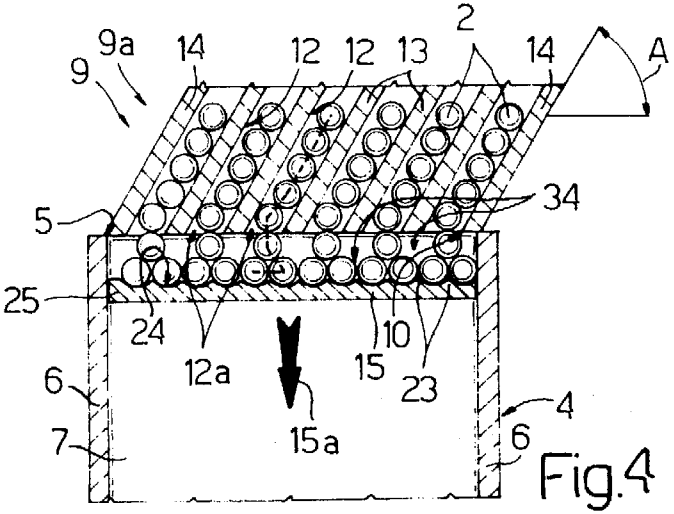
FIGS. 3 to 6 show smaller-scale views of the FIG. 2 detail in four different operating positions.
Figure 3:
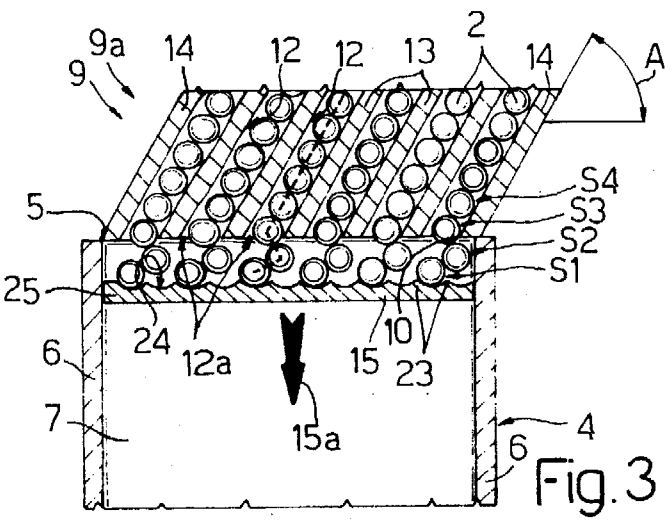
Figure 6:
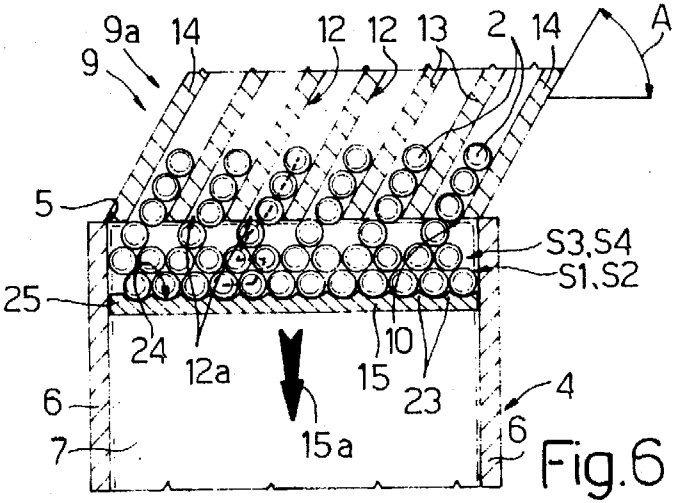
Figure 5:
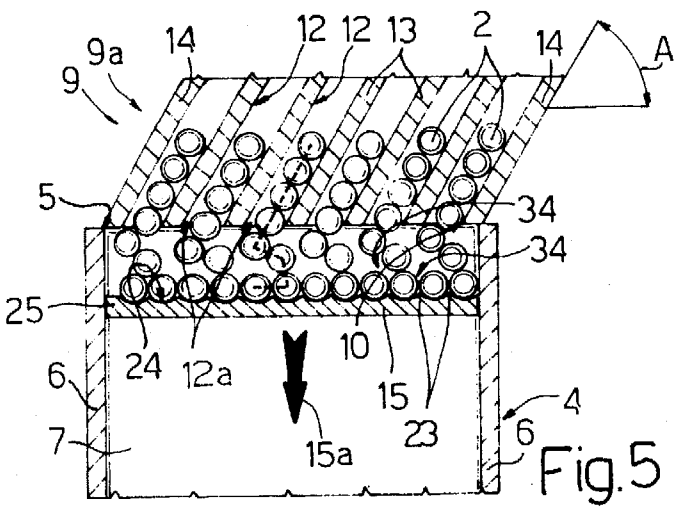

At the same time cigarettes 2 in layer S2 drop down into even seats 24, cigarettes 2 in layer S3 drop down into even seats 34 (FIG. 4). When plate 15 is lowered further, cigarettes 2 in layer S4 drop down between and are guided into odd seats 34 by cigarettes 2 in layer S3 (FIG. 5) which are momentarily unseated and then roll back into seats 34 so that layers S3 and S4 are also aligned in the same horizontal plane, and cigarettes 2 in layers S3 and S4 are offset in relation to those in layers S1 and S2 to form said quincuncial arrangement.

Repeated lowering of plate 15 provides for repeating the above cycle as many times as necessary to fill container 4 and secure plate 15 to walls 6 by means of clamping device 18.

At this point, valve device 30 arrests cigarettes 2 inside channels 12, and suction cup 28 releases plate 15 to enable the full container 4 to be replaced by an empty one.

Figure 7:
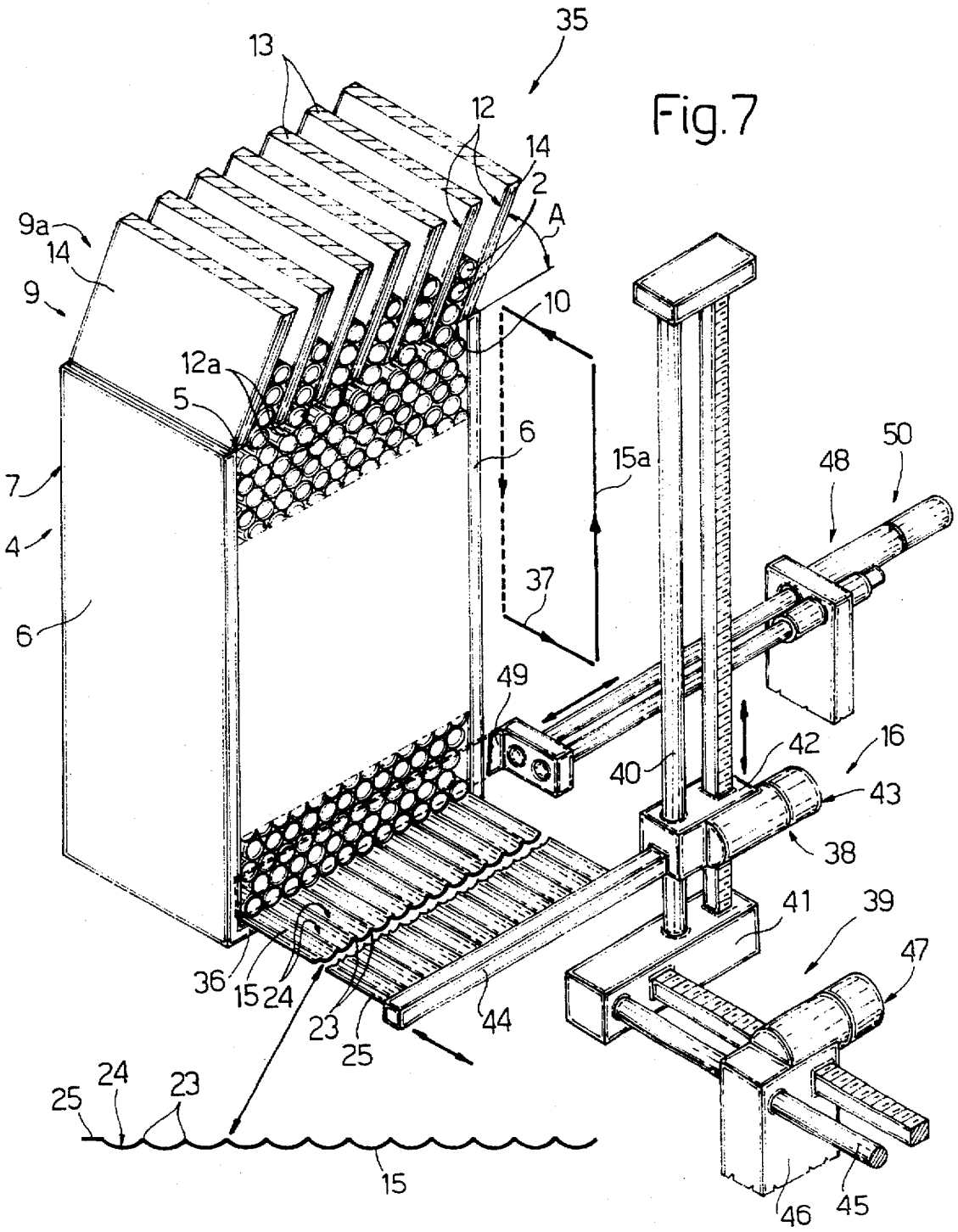
FIG. 7 shows a schematic view in perspective of a second preferred embodiment of the device according to the present invention.

The FIG. 7 variation relates to a device 35 similar to device 1, except that, as opposed to forming the bottom wall 19 of container 4, plate 15 in the lowered position simply rests on a fixed bottom wall 36 of container 4 which, in this case, presents no opening 8*a*. Moreover, in the lowered position contacting the upper surface of wall 36, plate 15 is extracted from container 4 parallel to itself and in a horizontal direction 37 crosswise to direction 15*a* and parallel to seats 24.

More specifically, actuating unit 16 comprises an actuating device 38 in place of and performing the same functions as actuating device 17; and a further actuating device 39 supporting and for moving device 38 in direction 37 to extract and insert plate 15 from/into container 4 when plate 15 is respectively in the lowered and raised position.

Device 38 comprises a vertical tubular guide 40 extending upwards from a supporting frame 41; and a slide 42 fitted to run along guide 40 and in turn supporting a powered rack-and-pinion assembly 43 and a horizontal arm 44. Arm 44 replaces suction cup 28, and is rigidly connected to a long side of plate 15, which projects from arm 44 towards container 4. Device 39 comprises a horizontal tubular guide rod 45 fitted to slide, in direction 37, through the base 46 supporting device 39; and a powered rack-and-pinion assembly 47, the output rack of which is parallel to rod 45, and, together with rod 45, supports the supporting frame 41 of device 38 on its free end facing container 4.

Device 35 also comprises a clamping device 48 in turn comprising a rectangular blade 49 perpendicular to seats 24 and substantially equal in length to the distance between lateral walls 6; and a linear actuator 50 for moving blade 49 to and from an engaged position (FIG. 7) directly over plate 15 in the lowered position, to prevent cigarettes 2 from being withdrawn from container 4 together with plate 15.

Operation of device 35 is readily discernible from the above description and that of the operation of device 1, and therefore requires no further explanation.

Figure 9:
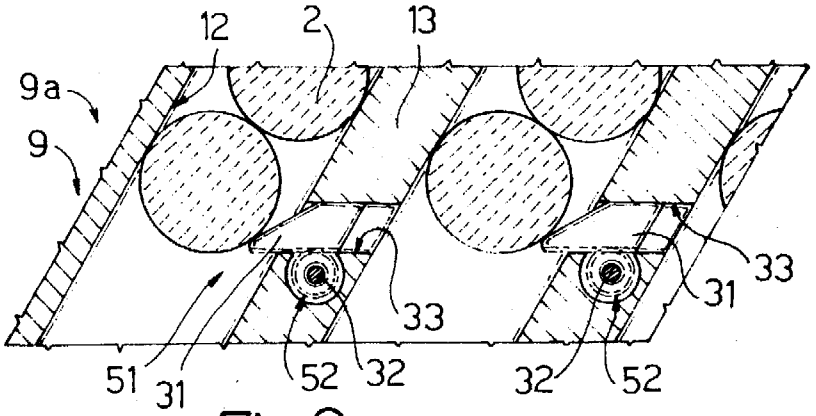
FIGS. 8 to 11 show larger-scale sections of respective embodiments of a detail common to the FIGS. 1 and 7 devices.

By way of a variation of control valve device 30, FIG. 9 shows a valve device 51 featuring a rack-and-pinion assembly 52 for controlling each element 31, and wherein the pinion is integral with pin 32, and the rack is formed directly on element 31 which travels inside seat 33 to and from a position partly engaging respective channel 12.

Figure 10:
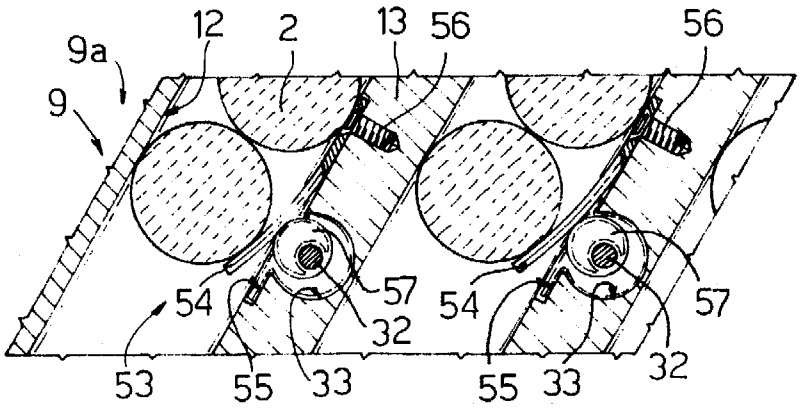

By way of a further variation of device 30, FIG. 10 shows a device 53 performing the same functions as device 30 but which, as opposed to elements 31, presents elastic blades 54, each of which is housed, parallel to partition 13, inside a seat 55 communicating with seat 33, is secured at one end to partition 13 by a respective screw 56, and the free end of which is oscillated to and from a position partly engaging channel 12 by a respective roller 57 fitted eccentrically to pin 32 inside seat 33.

Figure 11:
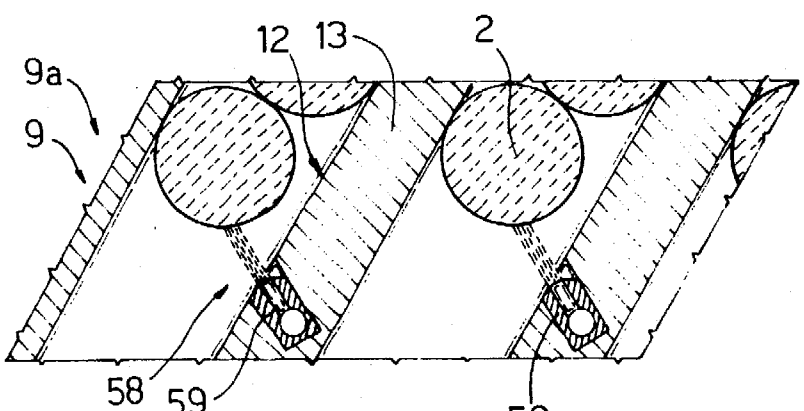

By way of a further variation of device 30, FIG. 11 shows a pneumatic control valve device 58 which, as opposed to elements 31, comprises nozzles 59 supplied by a known pneumatic device (not shown), and which provide for generating, across respective channels 12, respective air barriers for arresting the downward movement of cigarettes 2.

I claim:

1. A device (1; 35) for loading storage containers (4) for elongated articles (2), in particular tobacco products (2); the device comprising a feedbox (9*a*) for the articles (2), in turn comprising an outlet (9) defined by a number of side by side channels (12) for respective columns of said articles (2), each channel (12) presenting an output opening (12*a*), and said outlet (9) presenting a bottom output window (10) defined by said side by side output openings (12*a*); a horizontal plate (15) for receiving and supporting a mass of articles (2) issuing from said output window (10); and actuating means (16) for moving said plate (15) along a storage container (4) positioned, in use, with its input opening (5) beneath said output window (10); characterized in that the horizontal plate (15) presents, on top, side by side seats (24) for respective said articles (2); each seat (24) being separated by a rib (23) from each adjacent seat (24); each said output opening (12*a*) facing a rib (23) separating two respective adjacent seats (24) on the plate (15); and the channels (12) all being inclined to the same side in relation to the plate (15).

2. A device as claimed in claim 1, characterized in that said channels (12) are parallel to one another.

3. A device as claimed in claim 2, characterized in that said channels (12) form an angle (A) of 50 to 70 degrees with said plate (15).

4. A device as claimed in claim 2, characterized in that said channels (12) form an angle (A) of substantially 60 degrees with said plate (15).

5. A device as claimed in claim 1, characterized in that said seats (24) are equal in number to twice the number of said channels (12); each seat (24) presenting a width substantially equal to that of each channel (12).

6. A device as claimed in claim 5, characterized in that said seats (24) are substantially semicylindrical; said plate (15) presenting, at its lateral end opposite said side to which the channels (12) are inclined, a projection (25) parallel to said seats (24) and of a width substantially equal to the radius of the seats (24).

7. A device as claimed in claim 1, characterized in that said plate (15) is removable.

8. A device as claimed in claim 7, characterized in that it also comprises a number of said storage containers (4) selectively set to the loading position beneath said output window (10); and a number of said plates (15) selectively connectable to said actuating means (16); each plate (15), when set to the lowered position beneath said output window (10), defining the bottom wall (19) of a respective said storage container (4).

9. A device as claimed in claim 8, characterized in that, for each said storage container (4), it comprises snap-on clamping means (18) for clamping each said plate (15) in relation to the respective storage container (4) and in the lowered position.

10. A device as claimed in claim 1, characterized in that it comprises a number of stop means (30; 51; 53; 58) associated with each said channel (12) and for arresting the downward movement of the articles (2) in the respective columns inside the channels (12).

11. A device as claimed in claim 10, characterized in that said stop means (30; 51; 53) comprise, for each said channel (12), a movable stop member (31; 31; 54), and actuating means (32) for moving the movable stop member (31; 54) between an operating position in which it interferes with the respective channel (12), and an idle position in which it is clear of the respective channel (12).

12. A device as claimed in claim 10, characterized in that said stop means (58) are pneumatic, and generate an air barrier inside each channel (12).

* * * * *